United States Patent [19]

Abraham

[11] 4,265,090

[45] May 5, 1981

[54] GLASS DOOR MERCHANDISER WITH AMBIENT AIR DEFROST

[75] Inventor: Fayez F. Ibrahim, Niles, Mich.

[73] Assignee: Tyler Refrigeration Corporation, Niles, Mich.

[21] Appl. No.: 101,069

[22] Filed: Dec. 7, 1979

Related U.S. Application Data

[63] Continuation-in-part of Ser. No. 25,473, Mar. 30, 1979, and a continuation-in-part of Ser. No. 58,916, Jul. 19, 1979.

[51] Int. Cl.[3] ..... F25D 21/12; A47F 3/04; F25D 17/04

[52] U.S. Cl. ..... 62/82; 62/256; 62/408

[58] Field of Search ..... 62/255, 256, 455, 458, 62/248, 408, 151, 80, 82

[56] References Cited

U.S. PATENT DOCUMENTS

| | | | |
|---|---|---|---|
| 2,960,844 | 11/1960 | Quick | 62/408 X |
| 3,082,612 | 3/1963 | Beckwith | 62/408 X |
| 3,094,851 | 6/1963 | Beckwith | 62/256 |
| 3,226,945 | 1/1966 | Spencer | 62/256 |
| 3,229,475 | 1/1966 | Balk et al. | 62/256 |
| 3,304,736 | 2/1967 | Brennan et al. | 62/256 X |
| 3,371,503 | 3/1968 | Perez | 62/256 |
| 3,403,525 | 10/1968 | Beckwith et al. | 62/256 X |
| 3,850,003 | 11/1974 | Beckwith et al. | 62/256 X |
| 3,937,033 | 2/1976 | Beckwith et al. | 62/256 X |
| 4,026,121 | 5/1977 | Aokage et al. | 62/151 |
| 4,117,697 | 10/1978 | Myers et al. | 62/256 |
| 4,120,174 | 10/1978 | Johnston | 62/256 |
| 4,144,720 | 3/1979 | Subera | 62/256 |
| 4,182,130 | 1/1980 | Ljung | 62/256 |
| 4,197,718 | 4/1980 | Abraham | 62/248 |

*Primary Examiner*—Lloyd L. King

*Attorney, Agent, or Firm*—LeBlanc, Nolan, Shur & Nies

[57] ABSTRACT

A refrigerated display case having a display section within a cabinet and movable door covering the access opening to such display section. The cabinet has top, bottom, rear and side walls with an access opening in its front, which opening is covered by the door. An air conduit extends along the top, bottom and rear walls of the cabinet. The air conduit has an outlet opening and an inlet opening at opposing ends thereof with the openings being in alignment so that air leaving the outlet opening will be directed towards and received by the inlet opening thereby forming an air curtain across the front opening of the cabinet along the path inside the door. During a refrigeration cycle of operation of the display case, refrigerated air is circulated through the air conduit and a refrigeration mechanism arranged within the conduit by a positive pressure air flow so as to establish a refrigerated air band and a refrigerated air curtain across the front opening in the cabinet. During a defrost cycle of operation, the refrigeration mechanism is turned off and the door covering the front access opening is slightly opened. Ambient air is then drawn into the air conduit and circulated through the conduit. Such ambient air serves to defrost the refrigeration mechanism and the interior of the air conduit. After defrosting the refrigeration mechanism, the ambient air is expelled through the front access opening of the cabinet since the door has been slightly opened during the defrost cycle.

34 Claims, 7 Drawing Figures

GLASS DOOR MERCHANDISER WITH AMBIENT AIR DEFROST

RELATED APPLICATIONS

The present application is a continuation-in-part of applications Ser. No. 25,473 filed Mar. 30, 1979 and Ser. No. 58,916 filed July 19, 1979. Both of these applications are hereby incorporated by reference.

BACKGROUND OF THE INVENTION

The present invention primarily relates to a glass door merchandiser type of refrigerated display case. While reference is made herein to the use of glass doors since those are the types of doors most frequently utilized, other types of doors can be used within the scope of the present invention. In addition, the term refrigerated, in accordance with the present invention, is intended to incorporate both those cases maintained at a temperature either at or in excess of 32° F., such as display cases utilized for displaying milk and fresh foods, and those cases maintained below 32° F., such as frozen food cases.

In the operation of all types of refrigerated display cases, it is desirable to include a system capable of automatically defrosting the display case. The defrost cycle can be actuated either at set periodic times of when the frost buildup within the system has reached a certain predetermined level. Such systems are typically thermostatically controlled so as to switch from a refrigeration cycle to a defrost cycle of operation. In this manner of operation, it is possible to avoid any significant frost buildup within the display case.

Typically within the prior art, there have been three different approaches employed for defrosting refrigerated display cases. The three approaches include: utilizing electric resistance heater; passing a compressed gaseous refrigerant through the refrigeration coils; and, circulating ambient air through the air conduit. Due to the increasing cost of energy in recent years, efforts have been made to place more emphasis on the utilization of ambient air defrost systems in place of the electrical resistence heaters or compressed gaseous refrigerant defrost systems.

One type of system that employs ambient air during the defrost cycle is exemplified by those embodiments illustrated in U.S. Pat. Nos. 3,403,525, 3,850,003 and 3,937,033, all to Beckwith, et. al. These systems use fans separate and distinct from the main circulating fans. The additional fans are turned on only during the defrost cycle of operation for pulling ambient air from outside of the display case directly into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith, et al. U.S. Pat. No. 3,850,003 indicates that the concepts described in U.S. Pat. Nos. 3,082,612 and 3,403,525 did not prove to be practical and hence were not commercially feasible.

Another type of ambient air defrosting system is shown in U.S. Pat. No. 4,144,720 issued to Subera, et al. which is assigned to the same assignee as the present application. In the foregoing patent application, an open front refrigerated display case having primary and secondary air conduits is disclosed. In this system, the direction of air flow within one of the conduits is reversed, for example, by the use of reversible fans for ambient air defrost. U.S. Pat. No. 4,026,121 to Aokage, which illustrates an open front display case, and U.S. Pat. No. 4,120,174 to Johnston, which illustrates an open top display case, also disclose reverse ambient air flows for defrosting.

In those ambient air defrost systems disclosed in the above-noted patents which use a reverse air flow, during the defrost cycle of operation, ambient air can easily be drawn through the access opening into the air conduit through the outlet opening of the air conduit and then expelled from the air conduit after the defrost operation through the inlet opening and out of the cabinet through the access opening. Such an arrangement, however, cannot be readily used in a glass door type merchandiser refrigerated display case, since the front opening in the cabinet is covered by the doors. Thus, in order to employ an ambient air defrost system, a different type of system had to be developed.

In seeking to employ ambient air defrost techniques in a glass door case, systems have been developed for drawing in air over a limited portion of the air conduit by opening flaps to the conduit, which flaps are arranged so as to astraddle the evaporator coils of the refrigeration mechanism; such systems are disclosed in U.S. Pat. No. 3,226,945 to Spencer and U.S. Pat. No. 4,075,488 to Johnston. The patent to Spencer illustrates a plurality of different embodiments of open top refrigerated display cases, both of a single shelf and multi-shelf type, in which a glass cover is arranged over the opening in the display case. During the refrigeration cycle of operation, air is drawn through the evaporator coils by a negative pressure created upstream of the coils; such air after being refrigerated is circulated through the air conduit and into the display section of the case. The patent to Johnston discloses a glass door type merchandiser display case in which air is circulated through the air conduit and through the evaporator coils arranged within the air conduit in such a direction that cold air enters from the bottom of the opening in the cabinet and after passing across such opening is then drawn back into the air conduit by an air inlet located at the top of the opening in the cabinet. Such systems are relatively complex and can involve certain operational problems. Where there are moving parts inside of the air conduit an accummulation of frost on such parts can cause them to stick and hence not function properly.

SUMMARY OF THE INVENTION

An object of the present invention is to provide an improved ambient air defrosting open front refrigerated display case that has a movable door covering the access opening into the display section of the display case and avoids the problems involved in the operation of the ambient air defrost cycle.

Another object of the present invention is to provide a refrigerated display case having a movable door covering the front access opening with an improved ambient air defrost system.

A further object of the present invention is to provide a refrigerated display case having a movable door covering its front access opening that provides for a more efficient ambient air defrost operation than previously known display cases of this type.

Still another object of the present invention is to provide a glass door merchandiser refrigerated display case utilizing an improved ambient air defrost system.

A still further object of the present invention is to provide a glass door merchandiser refrigerated display case utilizing an improved ambient air defrost system where the air is circulated through the evaporator coils during a refrigeration cycle by a positive pressure air flow.

A still further object of the present invention is to provide a glass door merchandiser refrigerated display case utilizing an improved ambient air defrost system where during the defrost operation ambient air is circulated through at least a substantial portion of the air conduit and such ambient air is expelled through the front access opening after passing through the air conduit.

These objectives are achieved by the provision of a glass door type refrigerated display case in accordance with the present invention and the operation of such a case in accordance with the present invention. The refrigerated display case of the present invention has a cabinet with top, bottom, rear and side walls with an opening in its front and a display section within the cabinet. At least one door, which is generally a glass door, covers the front opening. The door is movable so as to enable access through the front opening to products within the display section of the display case. An air conduit extends along the top, bottom and rear walls of the cabinet and has an outlet opening and an inlet opening at opposing ends thereof. The outlet opening and the inlet opening are arranged in alignment so that air leaving the outlet opening will be directed towards and received by the inlet opening so as to form an air curtain across the front opening of the cabinet along a path inside of the door. In the air conduit, there are a refrigeration mechanism, which is typically either a single or plurality of evaporator coils, and at least one fan for circulating air through the conduit. The evaporator coils are located upstream of the fan so that air is circulated through the coils by a positive pressure air flow. During a defrost operation, the evaporator coils are turned off and ambient air is drawn into the air conduit and circulated through at least a substantial portion of the conduit, including that portion along the rear wall of the cabinet and that portion containing the evaporator coils, thereby defrosting the evaporator coils in the interior of the air conduit. After the ambient air has passed through the air conduit, it is expelled from the cabinet through the front access opening. In order to allow the ambient air to be so expelled, during the defrost cycle of operation, the door covering the access opening is opened slightly, preferably approximately 1 inch. The ambient air then can be directed so as to be expelled from the conduit in a direction out through the opening formed by the open door and in a path away from the display case.

The air outlet and inlet openings of the air conduit are aligned along a substantially vertical path across the front opening of the cabinet with the air outlet opening being near the top wall of the cabinet. Thus, during a refrigeration cycle of operation, a curtain of refrigerated air extends in a substantially vertical direction flowing from top to bottom across the front opening of the cabinet. During the defrost cycle of operation, the direction of air flow through the conduit is reversed as compared to the direction of air flow during a refrigeration cycle of operation.

While reference is made herein to the utilization of a fan for circulating air through the air conduit, it is noted that more than one fan may be utilized within the display case. The number of fans employed depends on the width of the display case. Typially, an eight foot wide display case utilizes two air circulating fans and a twelve foot case would use three air circulating fans. The number of fans, however, can be varied depending on the width of the case and the sizes of the fans. Likewise, the number of doors covering the front opening of the cabinet would vary depending on the width of the display case, with more doors being utilized for wider display cases. The doors on the case are attached by hinges to the case.

The ambient air for defrosting the display case can be drawn into the air conduit either through an aperture in the top of the cabinet or through an opening formed by opening the door of the case. In the later embodiment, the door covering the access opening is opened and the ambient air is drawn from outside of the cabinet through the open door and then in through the air outlet opening into the air conduit. In the prior of the two embodiments, the ambient air is drawn directly into the air conduit through an aperture in the top of the cabinet that is opened during the defrost cycle of operation.

With respect to the embodiment with an aperture in the top of the cabinet, in order to prevent the flow of ambient air into the display section of the display case, a blocking mechanism can be provided for controlling the air flow. The blocking mechanism is provided in conjunction with the aperture within the case that is in communication with the air conduit. When the display case is switched into a defrost cycle of operation, the aperture is opened and simultaneously a blocking member is extended into the air conduit for preventing the flow of air past the location of such blocking member. The direction of air flow through the air conduit is then reversed so that ambient air is drawn into the air conduit through the aperture in the top portion of the display case. The ambient air then passes through the air conduit for defrosting the evaporator coils and such air is expelled through the front access opening since the door has been opened. Thus, the ambient air is drawn in a reversed direction by a negative pressure through the evaporator coils.

During the defrost cycle of operation, it is possible to increase the quantity of air flowing through the air conduit during the defrost cycle of operation as compared to the air flow during a refrigeration cycle of operation in order to speed up the defrost operation. This increase in air flow can be on the order of 25 to 50 percent.

During the refrigeration cycle of operation, the aperture in communication with the air conduit is covered by a closure member thereby preventing air flow out of the case. During a defrost cycle of operation, however, the closure member is moved into a position for opening the aperture. In addition, during the defrost cycle of operation, a blocking member is moved into a position for blocking air flow through the top of the conduit into the display section of the case. The blocking member, however, is moved into a position for allowing air to flow through the conduit during a refrigeration cycle of operation.

During the defrost cycle of operation, the door covering the front access opening in the cabinet is opened slightly, between 1 and 4 inches preferrably about 1 inch. To accomplish this, a motor is connected to a drive linkage with a separate push rod associated with each door and arranged for pushing each door open during the defrost cycle. While normally a single motor can be used for controlling all of the doors of the display case, it is possible to use a separate motor for controlling each door. The motors typically would be mounted on the top of the cabinet and each door would have a bracket extending upwardly above the top of the cabinet.

By opening the front door during the defrost cycle of operation, the ambient air that has passed through the air conduit can be expelled from such conduit through the air inlet opening and then expelled from the cabinet through the open door. To assist in expelling the air from the cabinet the air inlet end of the air conduit can be appropriately shaped for directing the air away from the interior of the cabinet.

In addition to establishing a path along which ambient air can be expelled, the open door also can provide a path for drawing ambient air into the air conduit. Ambient air can be drawn into the air conduit from outside of the display case through the open door and then through the air outlet opening of the conduit. In this embodiment, the aperture in the top of the cabinet can be eliminated.

During the refrigeration operation, there is often a buildup of condensation at the location of the air inlet of the air conduit. This buildup of condensation occurs since the air moving across the front opening in the cabinet picks up moisture from the inside display section, which moisture is picked up from the ambient air when the door of the display case is opened. The buildup of condensation can and often does result in accumulation of a frost buildup which blocks at least a portion if not the entire inlet opening, thereby decreasing the efficiency of operation of the display case. Inasmuch as the ambient air during defrost is not being circulated through the inlet opening, the defrosting system will not serve to eliminate any frost buildup at the inlet opening. Consequently, some other mechanism must be provided in order to eliminate this buildup of frost at the inlet opening. For this purpose, a liquid refrigerant line can be arranged in the area of the inlet opening. Such line carries the liquid refrigerant before it is sent to the evaporator. Since such refrigerant is warmer than the refrigerated air, it will serve to maintain the temperature of the air in the area immediately surrounding the inlet opening at a level above the dew point, thereby minimizing the buildup of condensation and frost in this area. The use of such liquid lines systems is generally disclosed in U.S. Pat. No. 3,371,503 to Perez.

In operating the refrigerated display case of the present invention, air is circulated through the air conduit in a direction so that the refrigerated air is propelled through the refrigeration mechanism by a positive pressure air flow and such air is circulated through the conduit so as to flow in a substantially vertical direction across the opening in the cabinet in a direction flowing from the top to the bottom of such opening. Such air flow creates a refrigerated air curtain lying along a substantially vertical path with such curtain being located immediately inside of the movable door of the display case. During a defrost cycle of operation, the direction of air flow through the air conduit is reversed and ambient air is drawn into the air conduit, which ambient air serves to defrost the interior of the conduit and the refrigeration mechanism.

DESCRIPTION OF THE PREFERRED EMBODIMENTS

Figure 1:
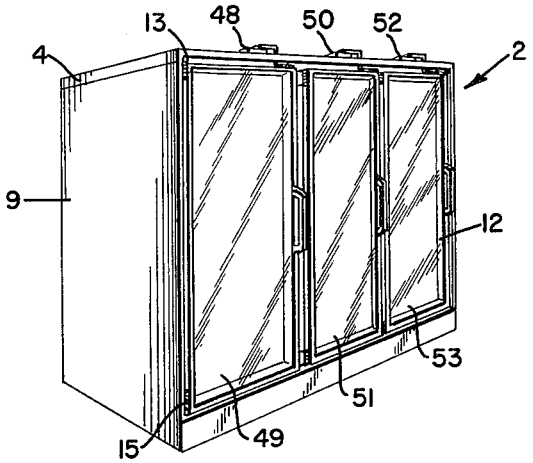
FIG. 1 is a perspective view of a glass door merchandiser type of refrigerated display case in accordance with the present invention.
Figure 2:
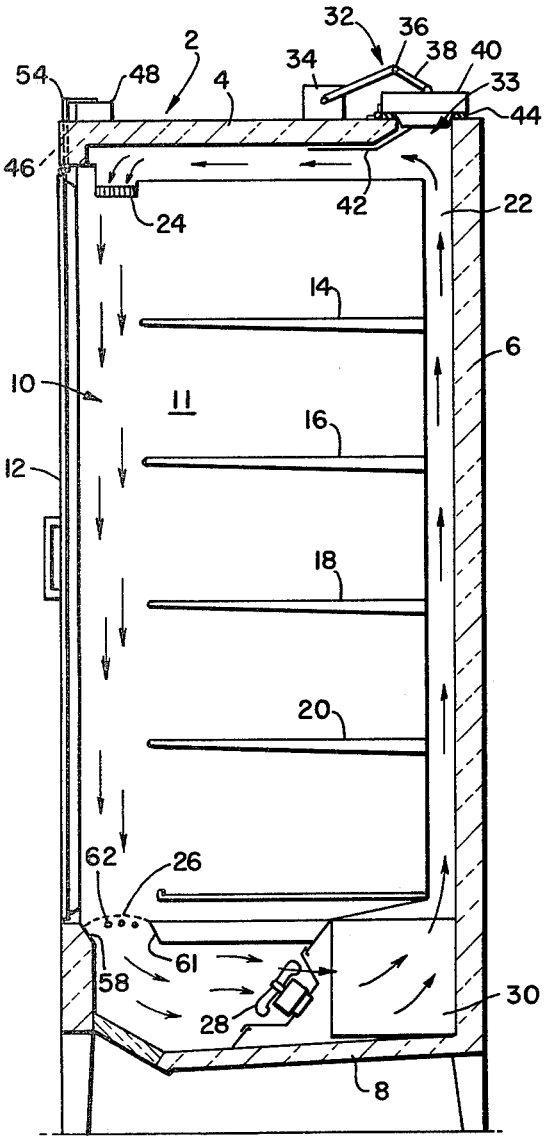
FIG. 2 is a side cross-sectional view of the refrigerated display case illustrated in FIG. 1 when such display case is being operated during a refrigeration cycle of operation.
Figure 3:
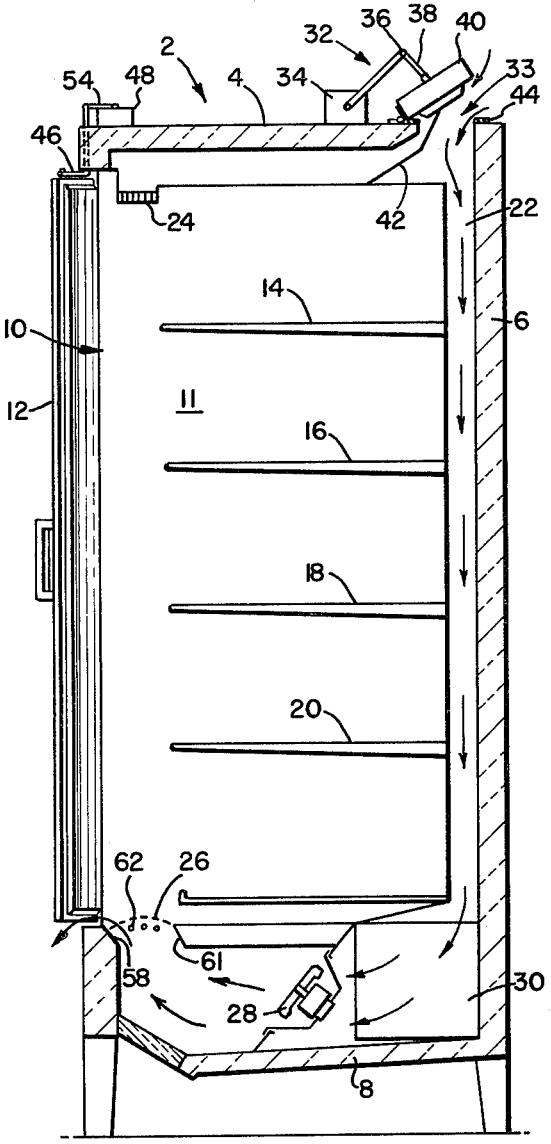
FIG. 3 is a view of the refrigerated display case similar to that shown in FIG. 2, except that the display case is being operated in a defrost cycle of operation.

A refrigerated display case 2 has a top wall 4, a rear wall 6, a bottom wall 8 and two side walls 9. Display case 2 has an opening 10 in its front which is covered by either a single or a plurality of glass doors 12. Each door is attached to the display case by a pair of hinges 13 and 15. Such a display case, one embodiment of which is shown in a perspective view in FIG. 1 and in cross-sectional views in FIGS. 2 and 3, is typically referred to as a glass door merchandiser. A glass door merchandiser refrigerated display case can be used for storing either fresh foods, such as dairy products, or frozen foods.

The interior of the display case has a display section 11 in which there are arranged a plurality of display shelves 14, 16, 18 and 20. Access to the refrigerated products on the display shelves is obtained by opening one of the doors 12 and reaching into the case through opening 10.

Surrounding display section 11 is an air conduit 22. Air conduit 22 extends along top wall 4, rear wall 6 and bottom wall 8 of the display case. Conduit 22 has an outlet opening 24 arranged near the top of the display case and an inlet opening 26 arranged near the bottom of the display case. Outlet opening 24 and inlet opening 26 are arranged in alignment so that air expelled through opening 24 is directed along a substantially vertical path towards and into inlet opening 26 so as to form a vertically extending air curtain across opening 10 in the front of display case 2. This air curtain is positioned inside of glass door 12.

Arranged within air conduit 22 is at least one fan 28 and an evaporator coil 30, or a plurality of such evaporator coils. Both fan 28 and evaporator coil 30 are arranged in the bottom portion of the air conduit. Fan 28 is positioned upstream of evaporator coil 30 so that the fan creates a positive pressure air flow through the coils during the refrigeration cycle of operation. Such a positive pressure air flow provides for better and more efficient air circulation than if the fan was located downstream of the coil, where it would rely on a suction or drawing action of the air through the coil.

During a refrigeration cycle of operation of display case 2, air is circulated by fan 28 through air conduit 22 so as to pass through evaporator coil 30. As the air passes through evaporator coil 30 it is refrigerated. Such refrigerated air is then expelled out of conduit 22 through outlet opening 24 along a path across opening 10 and back into inlet opening 26, where such air is then recirculated and again refrigerated.

It is intended that the display case of the present invention, such as represented by the exemplary embodiment illustrated in the drawings employ ambient air for purposes of defrosting both the interior of air conduit 22 and evaporator coil 30. Inasmuch as the front of the display case is covered by glass door 12, a mechanism must be provided for enabling ambient air from outside of the display case to be drawn into the case and passed through the conduit without such air entering display section 11.

In order to enable ambient air to be drawn into the air conduit during a defrost cycle of operation, the display case can be provided with an aperture in top wall 4. During the refrigeration cycle of operation, aperture 33 is closed by an appropriate closure member which will be described below. In addition door 12 is opened during the defrost cycle of operation for enabling the ambient air that has passed through the conduit to be expelled from the display case.

First considering aperture 33 in top wall 4 of the display case, this aperture is closed by a top gate mechanism 32 during the refrigeration cycle of operation. Gate mechanism 32 includes a motor 34, a first arm 36 and a second arm 38. At the end of arm 38 is a closure member 40. The gate mechanism in its normal position has arms 36 and 38 properly arranged so that closure member 40 is inserted into aperture 33 and sits against seat 44 in the top of the display case. Attached to closure member 40 is a blocking member 42. During the refrigeration cycle of operation, blocking member 42 allows air to pass through the upper portion of the air conduit so as to be expelled through outlet opening 24. The positions of the gate mechanism and the associated elements during a refrigeration cycle of operation are shown in FIG. 2. During the defrost cycle of operation, motor 34 pivots arms 36 and 38 so as to lift closure member 40 up and away from aperture 33, thereby allowing air to be drawn into conduit 22 through aperture 33 when the air flow direction is reversed. Simultaneously with the upward movement of closure member 40, blocking member 42 is pivoted into a position for substantially blocking the air flow through the conduit so as to prevent air from the display section from being drawn into air conduit 22 through outlet opening 24. Thus, the ambient air which is drawn into conduit 22 is prevented from being expelled through outlet opening 24 into display section 11 of display case 2.

Figure 4:
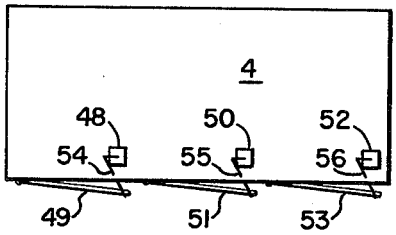
FIG. 4 is a top plan view of a portion of one embodiment of a glass door merchandiser type of refrigerated display case in accordance with the present invention.
Figure 5:
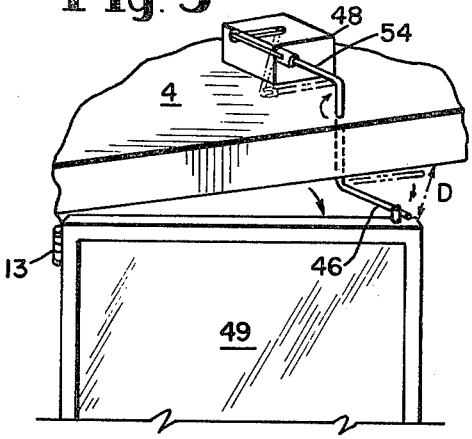
FIG. 5 is a perspective view of a portion of the display case shown in FIG. 4, with the linkage from the motor for opening the glass door during defrost being shown in both of it positions during defrost and refrigeration cycles of operations.

In order to open the door during the defrost cycle, either a single motor with linkage coupling it to each door or a separate motor for each door can be arranged on the top of the display case. As shown in FIG. 4, a plurality of motors 48, 50 and 52 are mounted on top wall 4. Each of the motors is associated with one of the doors, 49, 51 and 53 (these are those doors previously designated as doors 12 above). Motors 48, 50 and 52 are coupled to rotatable rods 54, 55 and 56 for pushing open doors 49, 51 and 53 respectively. As shown in FIG. 5, the rods push to doors by acting on lugs attached to the doors, such as lug 46. Each door is pivoted about its hinges when the respective motor is activated so as to slightly open the door by a distance D (see FIG. 5) of approximately 1 to 4 inches along the free longitudinal edge of the door.

The open door enables the ambient air emitted from air conduit 22 through opening 26 during the defrost cycle to be expelled from display case 2. To assist in the expulsion of the air through the open door, walls 58 and 61 of conduit 22 can be slanted outwardly, such as shown in FIGS. 2 and 3. This formation of walls 58 and 61 helps to direct the ambient air leaving opening 26 in a direction out of the open door and away from the display case.

Thus, during a defrost cycle of operation of the display case shown in FIGS. 2 and 3, closure member 40 is pivoted out of its aperture 33 and doors 12 are opened. The operation of fan 28 is reversed so that air flows through air conduit 22 in a direction opposite the air flow during a refrigeration cycle. With this reverse flow of air, ambient air from outside of the display is drawn in through aperture 33 into conduit 22. The ambient air flows along the portion of the conduit adjacent to the rear wall of display case 2. Such ambient air then flows through evaporator coil 30 and out of the open doors. The ambient air serves to defrost both the interior of conduit 22 and evaporator coil 30. The air flow paths during the refrigeration cycle and defrost cycles of operation are shown by the arrows in FIGS. 2 and 3.

During the refrigeration cycle of operation, it is possible for condensation to accumulate on the grill work at the inlet opening. Such condensation can eventually lead to a buildup of frost, thereby blocking the openings in the grill work. In order to minimize such a condition, liquid lines 62 can be provided adjacent each of the openings of the grill work at inlet opening 26. Such liquid lines contain liquid refrigerant which is in the process of being carried towards the evaporator coil. Since such liquid refrigerant is warmer than the air passing through inlet opening 26, the liquid refrigerant serves to eliminate the buildup of condensation and frost on the grill covering the inlet opening.

Figure 6:
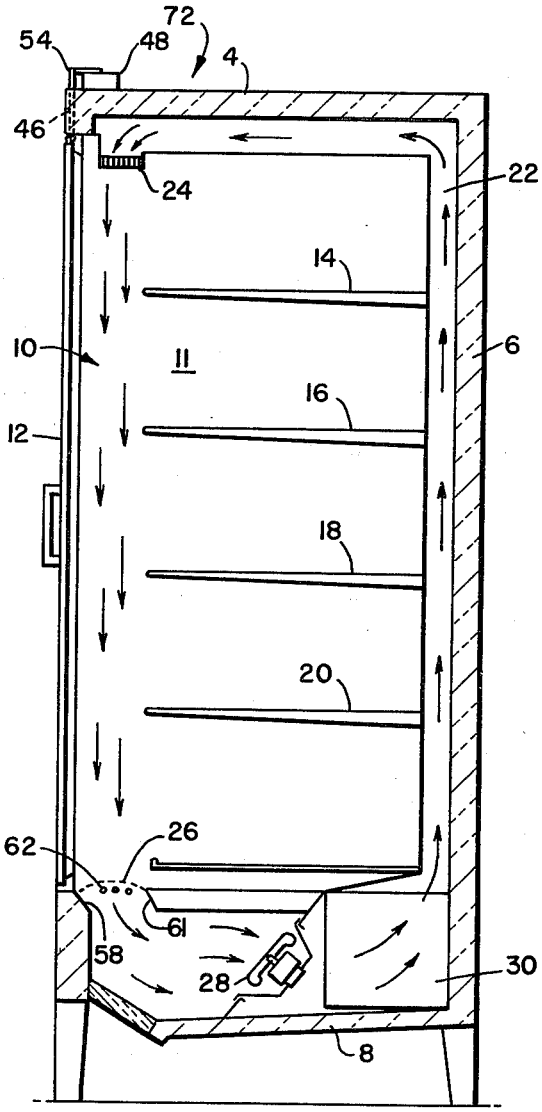
FIG. 6 is a side cross-sectional view of a modified embodiment of a glass door merchandiser type of refrigerated display case in accordance with the present invention when such display case is bing operated during a refrigeration cycle of operation.
Figure 7:
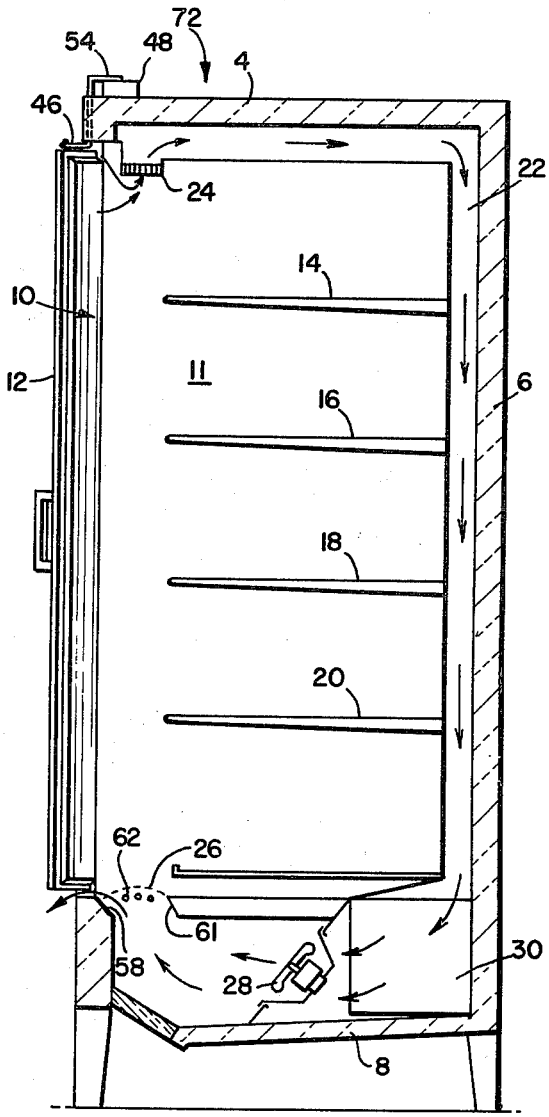
FIG. 7 is a view of the refrigerated display case similar to FIG. 6, except that the display case is being operated in a defrost cycle of operation.

In an alternative embodiment of the present invention, in refrigerated display case 72, as shown in FIGS. 6 and 7, ambient air is drawn into air conduit 22 through the open door instead of an aperture in top wall 4. The same reference numerals are used to designate the same elements as those in the embodiment illustrated in FIGS. 2 and 3 and discussed above. In addition, display case 72 has either a single motor or a plurality of motors and corresponding linkage for pushing open the doors, such as shown in FIGS. 4 and 5 and discussed above. The air flow during the refrigeration cycle of operation of display case 72 is shown by the arrows in FIG. 6. The air flow during the defrost cycle of operation of display case 72 is shown by the arrows in FIG. 7.

During the defrost cycle of operation of display case 72, ambient air is drawn through the tops of open doors 12 into air conduit 22 through air outlet opening 24. The ambient air then is circulated through the air conduit and leaves the conduit through air inlet opening 26. After the ambient air leaves air conduit 22 it is expelled from the display case through the open door.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A refrigerated display case having a display section therein comprising:

a cabinet having top, bottom, rear and side walls and an opening at its front, said top wall having an ambient air inlet aperture therein;

at least one door covering said front opening, said door being movable for enabling access through said front opening to products within said display section of said display case;

an air conduit extending along said top, bottom and rear walls and having an outlet opening and an inlet opening at opposing ends thereof, said outlet opening and said inlet opening being arranged in alignment so that air leaving said outlet opening will be directed towards and received by said inlet opening and form an air curtain across said front opening along a path inside of said door;

an air band establishing means for establishing a flow of refrigerated air through said air conduit during a refrigeration cycle of operation, said air band establishing means including refrigeration means and means for creating a positive pressure air flow through said refrigeration means; and defrost means for defrosting said display case when said display case is operated in a defrost cycle of operation, said defrost means causes ambient air to be drawn into said air conduit through said ambient air inlet aperture in said top wall of said cabinet and to pass through a substantial portion of said air conduit, including that portion of said air conduit located along said rear wall of said cabinet of said display case, and passing such ambient air through said refrigeration means for defrosting said refrigeration means and said air conduit and said defrost means including means for opening said door during a defrost cycle of operation for enabling the ambient air that has passed through said air conduit to be expelled out of said display case through said front opening.

2. A refrigerated display case according to claim 1 wherein said means for opening said door only causes said door to open a preset distance.

3. A refrigerated display case according to claim 2 wherein said door is only opened a distance of approximately 4 inches.

4. A refrigerated display case according to claim 1 or 3 wherein said defrost means causes the ambient air to flow in a reverse direction with respect to the air flow during a refrigeration cycle of operation.

5. A refrigerated display case according to claim 4 further comprising control means for selectively switching said display case between a refrigeration cycle of operation and a defrost cycle of operation.

6. A refrigerated display case according to claim 5 wherein said door is a glass door.

7. A refrigerated display case according to claim 1 or 3 wherein said outlet opening and inlet opening are aligned along a substantially vertical path with said outlet opening being near said top wall of said cabinet so that during a refrigeration cycle of operation a curtain of refrigerated air is formed so as to extend in a substantially vertical direction flowing from top to bottom across said front opening in said cabinet.

8. A refrigerated display case according to claim 7 wherein said door is a glass door.

9. A refrigerated display case according to claim 7 wherein said defrost means includes means for blocking the air flow through said air conduit from reaching said air outlet opening during the defrost cycle of operation.

10. A refrigerated display case according to claim 7 further comprising gate means for normally closing said aperture in said top wall during a refrigeration cycle of operation so that air is prevented from entering or leaving through said apertures during a refrigeration cycle of operation, and during a defrost cycle of operation said gate means moving in a direction for opening said aperture for enabling air to pass through said aperture.

11. A refrigerated display case according to claim 10 wherein said gate means includes a movable closure member movable between a closed position for covering said aperture during a refrigeration cycle of operation and an open position for opening said aperture during a defrost cycle of operation and a blocking member movable between an open position for allowing air flow through said outlet opening of said air conduit during a refrigeration cycle of operation and a closed position for blocking air flow through said air conduit from reaching said air outlet opening during a defrost cycle of operation.

12. A refrigerated display case according to claim 7 wherein said refrigeration means includes a set of evaporator coils, said evaporator coils being located in a portion of said air conduit along said bottom of said display case.

13. A refrigerated display case according to claim 7 further comprising means for substantially minimizing condensation and frost buildup in the area of said inlet opening.

14. A refrigerated display case according to claim 13 wherein said means for substantially minimizing condensation and frost buildup include liquid lines for carrying liquid refrigerant used in said refrigeration means and said liquid lines are arranged in the area of said inlet opening.

15. A refrigerated display case according to claim 1, 2 or 3 wherein said means for opening the door includes a lever that is arranged for pushing said door open and a motor for controlling the movement of said lever.

16. A refrigerated display case having a display section therein comprising:

a cabinet having top, bottom, rear and side walls and an opening at its front;

at least one door covering said front opening, said door being movable for enabling access through said front opening to products within said display section of said display case;

an air conduit extending along said top, bottom and rear walls and having an outlet opening and an inlet opening at opposing end thereof, said outlet opening and said inlet opening being arranged in alignment so that air leaving said outlet opening will be directed towards and received by said inlet opening and form an air curtain across said front opening along a path inside of said door;

an air band establishing means for establishing a flow of refrigerated air through said air conduit during a refrigeration cycle of operation, said air band establishing means including refrigeration means and means for creating a positive pressure air flow through said refrigeration means; and defrost means for defrosting said display case when said display case is operated in a defrost cycle of operation, said defrost means causes ambient air to be drawn into said air conduit and to pass through the entire said air conduit, and passing such ambient air through said refrigeration means for defrosting said refrigeration means and said defrost means including means for opening said door during a defrost cycle of operation for enabling the ambient air to be drawn through said front opening in said cabinet into said air conduit and enabling the ambient air that has passed through said air conduit to be expelled out of said display case through said front opening.

17. A refrigerated display case according to claim 15 wherein said means for opening said door only causes said door to open a preset distance.

18. A refrigerated display case according to claim 17 wherein said door is only opened a distance of approximately 4 inches.

19. A refrigerated display case according to claim 16 or 18 wherein said defrost means causes the ambient air to flow in a reverse direction with respect to the air flow during a refrigeration cycle of operation.

20. A refrigerated display case according to claim 19 further comprising control means for selectively switching said display case between a refrigeration cycle of operation and a defrost cycle of operation.

21. A refrigerated display case according to claim 20 wherein said door is a glass door.

22. A refrigerated display case according to claim 15 or 18 wherein said outlet opening and inlet opening are aligned along a substantially vertical path with said outlet opening being near said top wall of said cabinet so that during a refrigeration cycle of operation a curtain of refrigerated air is formed so as to extend in a substantially vertical direction flowing from top to bottom across said front opening in said cabinet.

23. A refrigerated display case according to claim 22 wherein said door is a glass door.

24. A refrigerated display case according to claim 21 wherein said refrigeration means includes a set of evaporator coils, said evaporator coils being located in a portion of said air conduit along said bottom of said display case.

25. A refrigerated display case according to claim 21 further comprising means for substantially minimizing condensation and frost buildup in the area of said inlet opening.

26. A refrigerated display case according to claim 25 wherein said means for substantially minimizing condensation and frost buildup include liquid lines for carrying liquid refrigerant used in said refrigeration means and said liquid lines are arranged in the area of said inlet opening.

27. A refrigerated display case according to claim 16, 17 or 18 wherein said means for opening the door includes a lever that is arranged for pushing said door open and a motor for controlling the movement of said lever.

28. A method of operating a refrigerated display case having:

a cabinet with top, bottom, rear and side walls, an interior display section, and an opening at its front for enabling access to products within said display section; at least one door covering the front opening and being movable for enabling access through the front opening, an air conduit extending along the top, bottom and rear walls and having an outlet opening and an inlet opening at opposing ends thereof, with the outlet opening and the inlet opening being arranged in alignment so that air leaving the outlet opening will be directed towards and received by the inlet opening; and an evaporator coil being arranged within the air conduit;

the method comprising the steps of:

selectively operating the display case in a refrigeration cycle of operation and a defrost cycle of operation;

during a refrigeration cycle of operation, circulating air through the air conduit so that air is expelled from the outlet opening and received by the inlet opening so as to form an air curtain across the front opening in the cabinet along a path inside of the door, propelling the air through an evaporator coil and refrigerating such air by using the evaporator coil as the air is circulated through the air conduit; and during a defrost cycle of operation, causing unrefrigerated ambient air to be drawn into the air conduit and to pass through the air conduit, including that portion located along the rear wall of the cabinet, and opening the door and expelling the ambient air that has passed through the air conduit from the cabinet through the front opening in the cabinet.

29. A method according to claim 28 wherein the curtain of refrigerated air extends in a substantially vertical direction across the front opening in the cabinet.

30. A method according to claim 28 or 29 wherein the air flow through the air conduit during the defrost cycle of operation is in a direction opposite the direction of air flow during a refrigeration cycle of operation.

31. A method according to claim 30 further comprising the step of minimizing condensation and frost build up in the area of the inlet opening.

32. A method according to claim 30 wherein the quantity of air flowing through the air conduit during a defrost cycle of operation is 25 to 50% greater than the air flow during the refrigeration cycle of operation.

33. A method according to claim 28 wherein during a defrost cycle of operation the door covering the front opening is opened a preset distance.

34. A method according to claim 33 wherein during a defrost cycle of operation the door is opened a distance of approximately 4 inches.

* * * * *